United States Patent [19]

Phillips

[11] 4,319,853

[45] Mar. 16, 1982

[54] GEODESIC DOME STRUCTURE TIE-BEAM CONNECTOR

[76] Inventor: Martha E. Phillips, 3906 Ridgecroft Rd., Baltimore, Md. 21206

[21] Appl. No.: 122,988

[22] Filed: Feb. 20, 1980

[51] Int. Cl.[3] ..... F16B 7/00

[52] U.S. Cl. ..... 403/172; 52/80

[58] Field of Search ..... 403/172, 176, 171, 174, 403/178; 52/81, 80

[56] References Cited

U.S. PATENT DOCUMENTS

| | | | |
|---|---|---|---|
| 3,186,522 | 6/1965 | McCauley | 52/81 X |
| 3,486,278 | 12/1969 | Woods | 52/81 |
| 3,990,195 | 11/1976 | Gunther | 52/81 |
| 4,122,646 | 10/1978 | Sapp | 403/176 X |

*Primary Examiner*—Andrew V. Kundrat

*Attorney, Agent, or Firm*—John F. McClellan, Sr.

[57] ABSTRACT

A geodesic dome structure tie-beam connector provides an axially swept-back, flexibly alignable, circular array of paired-jaw bolt-tightened vises for holding respective tenon-ends of tie beams; each vise jaw pair is on the end of and generally aligned with a respective radially deployed rib and the jaws of each vise-jaw are axially spaced relative to the connector axis so that they clamp in a direction radial to a geodesic dome in which employed and can provide through oversize holes a degree of circumferential adjustment of the associated tie beams relative to a geodesic dome while preserving structural stiffness in directions radial to a geodesic dome as for example, in resisting snowloads; clear wrenching access for all types of wrenches is provided by the vise orientation.

4 Claims, 2 Drawing Figures

GEODESIC DOME STRUCTURE TIE-BEAM CONNECTOR

This invention relates generally to geodesic dome structures and particularly to strut connectors for such structures.

Principal objects of the invention are to provide quick-connector design which is rigid in radial direction relative to the dome but which is flexibly yielding in circumferential direction such that the construction of geodesic domes can proceed at speed without loss of form or strength.

PRIOR ART

In the prior art numerous geodesic dome connector designs have been disclosed including those in the following U.S. Pat. Nos.:

3,186,522 to G. W. McCauley, 6-1-665, discloses a geodesic dome connection system in which the long pieces are received between two plates which in turn connect to flanges radiating from a center, the plates and the flanges are in parallel planes;

3,486,278 to B. L. Woods, 12-30-69, discloses a geodesic dome connection system in which over and under plates are in parallel planes and receive the long pieces between them with fasteners reaching through turned-down edges of the plates; the central part of the unit is a sleeve or tube;

3,999,195 to R. R. Gunther, 11-9-76, discloses radial spider structure requiring splitting the ends of the long pieces or struts.

However, none of the known prior art is believed to provide the design advantages of the present invention. In particular, relative working of the members in a radial direction is known to cause leakage and to be unnecessary, but a problem has been how to preserve the dome shape by accommodation of the dome-forming elements while preventing such radial working and maintaining full strength of the elements in assembly.

Further objects are to provide geodesic dome connector structure in which the circumferential yielding is limited in amplitude and can be adjusted and fixed to some degree.

Still further objects are to provide geodesic dome connector structure which gives full access to fasteners at all times, which reinforces the beams held by it and prevents splitting, which retards fall-through of the beams on assembly, which is economical to manufacture, to ship and to install, which is easy to use, which is adaptable to suit junction demands as to numbers of elements coming together, which is lightweight, strong, and handsome in appearance.

And yet further objects are to provide in combination a geodesic dome structure tie-beam connector with an axially swept back, flexibly alignable, circular array of paired-jaw bolt-tightened vises for holding respective tenon ends of tie-beams, each vise jaw pair being on the end of a respective radially deployed rib and in general alignment therewith, and the jaws of each vice-jaw pair being axially spaced relative to the connector axis so that they clamp in a direction radial to a geodesic dome in which employed and can provide through oversize holes a degree of circumferential adjustment of the associated tie-beams relative to a geodesic dome while preserving structural stiffness in directions radial to a geodesic dome, as for example as in resisting snow loads.

The above and other objects and advantages of this invention will become more readily apparent on examination of the following description, including the drawings in which.

Figures 1, 2:
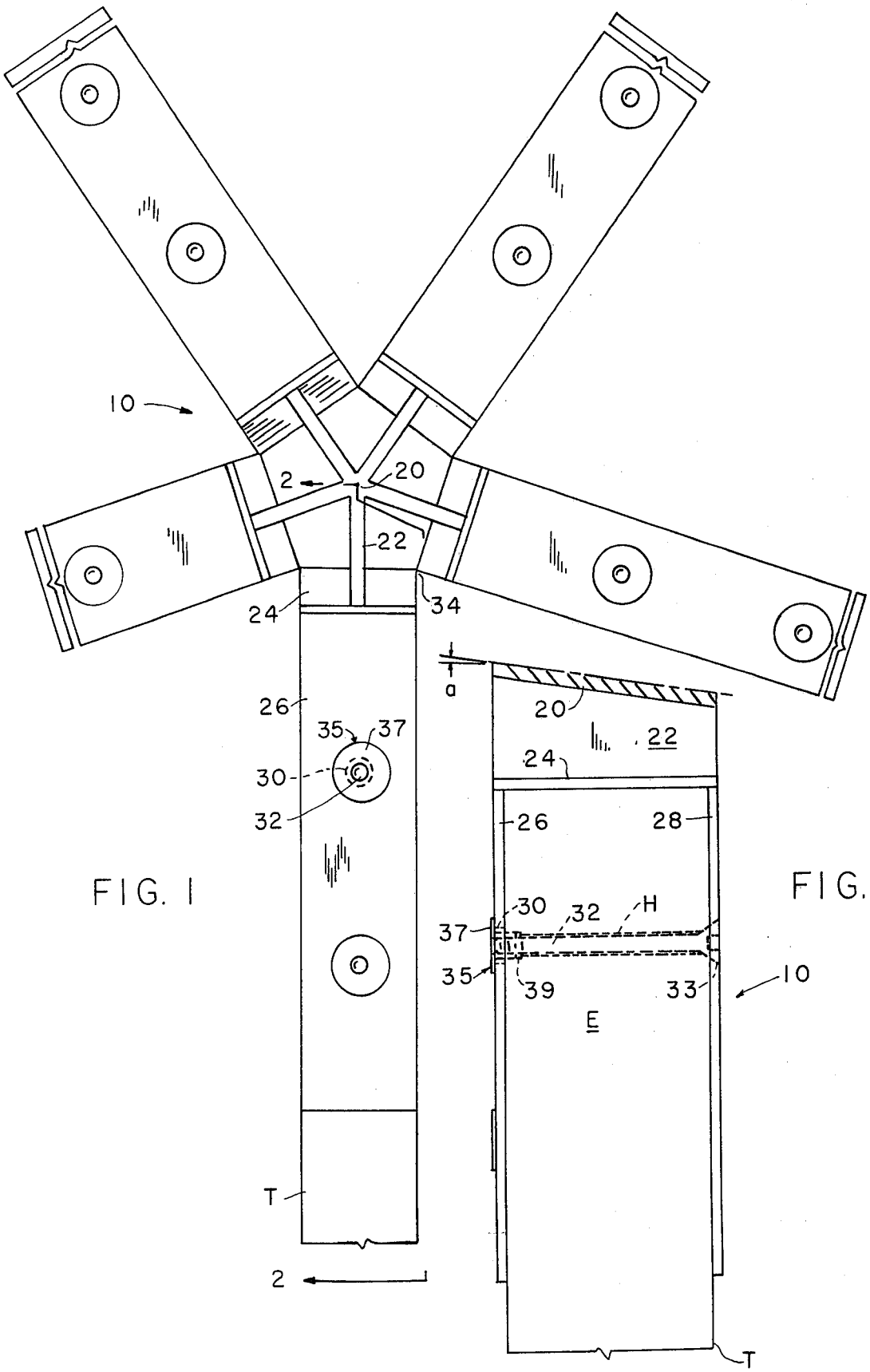
FIG. 1 is a top plan view of a typical embodiment.
FIG. 2 is an elevational detail partly in section adapted from 2—2, FIG. 1.

By definition a geodesic dome has been called a dome or vault made of light straight structural elements largely in tension and intended to reduce the weight and assembly difficulty of enclosures and make construction more economical. The elongate members or tie beams being largely in tension form with the connectors, individual lattice modules, interlocked to comprise the total structure, but in many environmental situations such as under wind loads may desirably also be rigid in bending in and out.

FIGS. 1 and 2 show the invention in the embodiment of a five-arm connector 10 formed by welded or other central juncture at 20 of five equal length ribs 22 along an axis to which they are swept-back equally from the perpendicular; the angel "a" of incline may be ten degrees.

Each rib is a rectangular-section elongate member or strap with the greater sectional dimension or height lying in a plane parallel to said axis and radial to the juncture.

The outer end of each rib is perpendicular to the length. Welded squarely and symmetrically across the outer end of each rib is a transverse rectangular plate 24 of the same height as the rib.

Welded perpendicularly to the top of each transverse plate is a first vice jaw or perforate outer plate 26 and similarly a second vice jaw or perforate inner plate 28 is welded to the bottom of each transverse plate in parallel spacing with the first relative to the axis. The two perforate plates form the arms of a square "U" of which the transverse plate is the throat. The rib joins to the transverse plate in a plane at right angles to the planes of the vice jaws.

Corresponding sets of coaxial holes 30 spaced apart on the longitudinal centerline of each pair of jaws receive respective bolts 32 through the jaws. Fitting tenon ends E of tie beams T drilled with corresponding holes H for the bolts are held clamped rigidly between the perforate plates by the bolts when tightened.

The bolt heads 33 may be of the countersunk or flathead type, either slotted or with recess for an "Allen"-type wrench and similarly the nuts 35 may be of the recessed type with thin flanges 37 and conventional shank teeth 39 to prevent turning. This substantially flush engagement of the bolts with the vice jaws keeps the jaw surfaces relatively smooth for application of sheathing inside and out. Access for tightening the bolts is excellent, both the head and the nut being exposed clear of obstruction for access by every type wrench.

The invention offers several controls for geodesic dome variables. Flexure and slack in the radial direction relative to the dome are practically eliminated by the rigidity of the ribs in bend in directions axial to the connector, and by the vise-like clamping between jaws on the beams. If two-by-four tie beams are used, the depth may as shown be radial to the dome. Flexible accommodation in circumferential direction is provided by bend of the ribs in circumferential direction relative to the connector without splitting the tie-beams. This bend can be limited by making the ribs of a length to cause contact after desired degree of flexure, between the ends of the rectangular plates. This depends on the gap 34 between the sides of the transverse plates which can be varied in manufacture by varying the relative length of rib and width of transverse plate, or can be done by filing the adjacent edges of the transverse plates. As shown, the transverse plates are touching.

Further, a degree of circumferential initial adjustment may be built into the assembly by making the holes slightly oversize, easing stresses on the tie beams as well as on the connectors. It will be appreciated that this invention requires no saw cuts or splits of the tenon-ends of the tie-beams, and because of the shell-conforming disposition of the pairs of vice jaws retards fall-through of the tie beams more than in prior art designs known.

It will be apparent that the invention is easily adapted to have less or more ribs or to hold narrower or wider tie beams by varying the length of the ribs and the width of the plates as desired.

Materials for the connector can be steel or aluminum but because of the flexible yet self-buttressing design can be of fibreglass, desirably limiting weight and cost and condensation problems. For the jaws and transverse plates, thickness of steel may be from one to three millimeters and other materials proportionally, with 2×4 tie beams and for the ribs twice as thick.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a connector for geodesic domes, of the type having a plurality of rectangular-section ribs radiating, in equal circumferential spacing, from juncture of the same along an axis, with each rib oriented so that the height of each rib is in a plane parallel to said axis, and with each rib inclined equally from the perpendicular to the axis for holding tenon-ends of tie-beams in generally circumferential alignment relative to a geodesic dome, the improvement comprising: means for clamping tie-beam tenon ends rigidly in direction radial to a said geodesic dome while providing limited flexure and adjustment in direction circumferential of a said geodesic dome, including a respective transverse plate affixed squarely and symmetrically across the outer end of each rib, a pair of flexible vice-jaws extending from each transverse plate in an outward direction generally aligned with the direction of radiation of a respective rib and spaced apart along said axis, each pair of flexible vice jaws having first and second aligned sets of holes for receiving bolts therethrough and through a tenon end of a tie-beam for drawing together said vise-jaws and clamping the tie-beam.

2. In a connector as recited in claim 1, the connector further enclosing means for limiting flexure thereof in direction circumferential of a geodesic dome, comprising each transverse plate being of a width relative to the length of said ribs producing on flexure of said transverse plate contact between it and an adjacent transverse plate.

3. In a connector as recited in claim 2, the means providing limited adjustment including at least one of said sets of holes being oversize sufficiently to permit lateral movement of a bolt therethrough.

4. In a connector as recited in claim 3, each bolt having substantially flush engagement at an end thereof with a respective said vice jaw.

* * * * *